US007827915B1

(12) United States Patent
Hall et al.

(10) Patent No.: US 7,827,915 B1
(45) Date of Patent: Nov. 9, 2010

(54) GAS CHECK WITH SYSTEM FOR IMPROVED LOADING AND RETENTION IN BORE OF MUZZLELOADING FIREARMS

(75) Inventors: Daniel W. Hall, Caldwell, ID (US); Harold Crowson, Caldwell, ID (US)

(73) Assignee: Accura Bullets, Nampa, ID (US)

( * ) Notice: Subject to any disclaimer, the term of this patent is extended or adjusted under 35 U.S.C. 154(b) by 704 days.

(21) Appl. No.: 11/765,025

(22) Filed: Jun. 19, 2007

Related U.S. Application Data

(63) Continuation-in-part of application No. 10/896,160, filed on Jul. 20, 2004, now abandoned, which is a continuation-in-part of application No. 10/259,374, filed on Sep. 27, 2002, now Pat. No. 6,763,765, application No. 11/765,025, which is a continuation-in-part of application No. 11/318,076, filed on Dec. 23, 2005, now Pat. No. 7,444,942.

(60) Provisional application No. 60/817,904, filed on Jun. 30, 2006, provisional application No. 60/325,530, filed on Sep. 27, 2001.

(51) Int. Cl.
*F42B 14/06* (2006.01)

(52) U.S. Cl. ..... 102/520; 102/532; 42/90

(58) Field of Classification Search ..... 102/520–528, 102/532; 42/90
See application file for complete search history.

(56) References Cited

U.S. PATENT DOCUMENTS

| | | | | |
|---|---|---|---|---|
| 1,410 A | | 11/1839 | Lindner | |
| 26,016 A | * | 11/1859 | Cochran | 102/526 |
| 34,590 A | | 3/1862 | James | |
| 35,273 A | | 5/1862 | Williams | |
| 36,879 A | | 11/1862 | Bird | |
| 39,112 A | | 7/1863 | Berney | |

(Continued)

FOREIGN PATENT DOCUMENTS

| | | | |
|---|---|---|---|
| AT | 35741 | 12/1908 | 102/520 |

(Continued)

OTHER PUBLICATIONS

English translation of Italy 289,179 (Breda).

*Primary Examiner*—Troy Chambers
(74) *Attorney, Agent, or Firm*—Parsons & Goltry; Michael W. Goltry; Robert A. Parsons

(57) ABSTRACT

A muzzle loading bullet gas check has external recess and ridge system, and/or an internal locking ridge system. The preferred gas check has an opening or recess on its front end for receiving and frictionally engaging a rearwardly extending post of the bullet, the opening also preferably including an internal radial ridge for gripping the post and/or locking with an indent on the post. The barrel-interacting part of the gas check has one or more external recesses and adjacent radial ridges/edges protruding relative to the recesses, which serves to reduce the total surface area of the gas check contacting the bore. The recesses do not touch the bore of the firearm, resulting in less friction and easier loading, while the outer ends/surfaces of the ridges/edges do touch the bore to retain the bullet in the bore during handling and hunting and to effectively capture gasses after the firing explosion.

17 Claims, 7 Drawing Sheets

U.S. PATENT DOCUMENTS

| | | | | | |
|---|---|---|---|---|---|
| 41,668 | A | | 2/1864 | Absterdam | |
| 43,017 | A | | 6/1864 | Ganster | |
| 44,492 | A | | 9/1864 | Williams | |
| 47,754 | A | * | 5/1865 | Smith | 102/526 |
| RE6,027 | E | | 8/1874 | Parrott | |
| 178,595 | A | * | 6/1876 | Butler | 102/525 |
| 193,657 | A | * | 7/1877 | Hotchkiss | 102/525 |
| 214,843 | A | * | 4/1879 | Reilly | 102/526 |
| 384,574 | A | * | 6/1888 | Hawley | 102/520 |
| 405,690 | A | | 6/1889 | Ball | |
| 1,044,360 | A | | 11/1912 | DuBois | |
| 1,327,655 | A | | 1/1920 | Dougan | 102/522 |
| 2,389,846 | A | | 11/1945 | Ericson | 102/93 |
| 2,911,911 | A | | 11/1959 | White | 102/532 |
| 2,983,225 | A | | 5/1961 | Walker | 102/93 |
| 3,345,949 | A | * | 10/1967 | Nosler | 102/516 |
| 3,452,677 | A | * | 7/1969 | Abela | 102/436 |
| 3,744,426 | A | | 7/1973 | Butler | 102/527 |
| 4,043,267 | A | | 8/1977 | Hayashi | 102/38 |
| 4,047,466 | A | | 9/1977 | Berman | 89/14 R |
| 4,175,493 | A | | 11/1979 | Dailey | 102/532 |
| 4,301,733 | A | * | 11/1981 | Arciniega Blanco | 102/517 |
| 4,384,529 | A | | 5/1983 | Burns et al. | 102/525 |
| 4,434,718 | A | | 3/1984 | Kopsch et al. | 102/522 |
| 4,549,488 | A | | 10/1985 | Hoffmann et al. | 102/522 |
| 4,587,905 | A | | 5/1986 | Maki | 102/532 |
| 4,977,834 | A | * | 12/1990 | Denis | 102/439 |
| 5,097,615 | A | | 3/1992 | Kearns | 42/90 |
| 5,150,909 | A | * | 9/1992 | Fitzwater | 473/569 |
| 5,458,064 | A | | 10/1995 | Kearns | 102/520 |
| 5,621,187 | A | * | 4/1997 | Kearns | 102/520 |
| 5,686,693 | A | | 11/1997 | Jakobsson | 102/501 |
| 5,915,938 | A | | 6/1999 | Moore | 42/83 |
| 5,987,799 | A | | 11/1999 | Dedeaux et al. | 42/90 |
| 6,085,454 | A | | 7/2000 | Caudle | 42/90 |
| 6,105,506 | A | | 8/2000 | Gangale | 102/439 |
| 6,477,958 | B1 | | 11/2002 | Leblond et al. | 102/439 |
| 6,481,356 | B2 | * | 11/2002 | Gualandi | 102/439 |
| 6,510,643 | B2 | * | 1/2003 | O'Dwyer | 42/84 |
| 6,763,765 | B2 | * | 7/2004 | Crowson | 102/522 |
| 6,796,068 | B2 | * | 9/2004 | Crowson et al. | 42/51 |
| 7,000,547 | B2 | * | 2/2006 | Amick | 102/501 |
| 2002/0050224 | A1 | * | 5/2002 | Crowson et al. | 102/525 |
| 2003/0056416 | A1 | * | 3/2003 | Crowson | 42/51 |
| 2004/0079256 | A1 | | 4/2004 | McMurray et al. | 102/520 |
| 2005/0115451 | A1 | * | 6/2005 | Crowson | 102/525 |
| 2006/0123684 | A1 | * | 6/2006 | Bunney | 42/60 |

FOREIGN PATENT DOCUMENTS

| | | | |
|---|---|---|---|
| CH | 488990 | 5/1970 | 102/525 |
| DE | 2606135 | 8/1977 | 102/520 |
| DE | 4403725 | 8/1994 | |
| FR | 23676 | 12/1921 | |
| FR | 618600 | 3/1927 | 102/520 |
| GB | 1667 | 0/1868 | 102/525 |
| IT | 289179 | 8/1935 | 102/525 |
| IT | 299613 | 11/1936 | 102/525 |
| IT | 305202 | 12/1936 | 102/522 |

* cited by examiner

GAS CHECK WITH SYSTEM FOR IMPROVED LOADING AND RETENTION IN BORE OF MUZZLELOADING FIREARMS

This application claims benefit of priority of Patent Application Ser. No. 60/817,904, filed Jun. 30, 2006; this application is a continuation-in-part of application Ser. No. 10/896,160, filed Jul. 20, 2004, which is a continuation-in-part of application Ser. No. 10/259,374, filed Sep. 27, 2002 and issued on Jul. 20, 2004 as U.S. Pat. No. 6,763,765, which is a non-provisional of Provisional Application 60/325,530, filed Sep. 27, 2001; and this application is also a continuation-in-part of application Ser. No. 11/318,076, filed Dec. 23, 2005, the disclosures of all of which are incorporated herein by this reference.

BACKGROUND OF THE INVENTION

1. Field of the Invention

The invention relates generally to firearms, and more specifically to muzzleloading firearms. The invention is a gas check connected to the rear part of a muzzleloader projectile, or bullet, the gas check comprising an external radial ridge for easier loading and/or a radial internal locking edge for better securing the gas check to the projectile.

2. Related Art

To function most effectively, muzzle-loading firearms preferably involve the use of a bullet in conjunction with some type of wad or gas check member. Throughout the history of such firearms, various configurations that embrace this design principle have been utilized. The wad or gas check is used to secure the bullet properly within the bore without significant deformation of the bullet, and to prevent the escape of forward thrusting gases around the bullet upon firing the firearm. Prior to the use of wads or gas checks, a malleable lead bullet, with a diameter necessarily greater than that of the bore of the firearm, was ram-rodded down the barrel. In this manner, the bullet was frictionally secured in place over the powder charge and engaged with the rifling of the bore, but was often malformed when being so placed.

The use of sabots or wrappers was later introduced to facilitate another mechanism of securing the bullet in place in the bore of the barrel. These devices surround a sub-caliber bullet to engage the rifling and secure the bullet without requiring the deformation of a large diameter bullet. When the firearm is discharged, the interaction between wrapper and rifling imparts spin to the bullet. C. T. James and A. Ball obtained U.S. Pat. Nos. 34,950 and 405,690, respectively, for such wrapper-type devices.

D. D. Williams, U.S. Pat. No. 35,273, and G. P. Ganster, U.S. Pat. No. 43,017, acquired patents for inventions in which the wad was directly attached to the bullet for use in muzzleloading firearms.

Significant reductions in the efficiency of such firearms often result from destructive interactions between the bullet and bore. When wrappers are used to surround the bullet, the positioning of the wrapper between the bullet and bore may affect the ballistic qualities of the shot. In the case of large-diameter bullets, the scoring and deformation of the projectile that results from the loading process may affect the discharge of the bullet from the bore as well as the in-flight aerodynamics.

U.S. Pat. No. 5,458,064 (Kearns) discloses a gas check affixed to the rear of a bullet, for the purpose of capturing and controlling the forward-thrusting gasses. The Kearns gas check is connected to the bullet by means of a pin extending from, or into a cavity of, the back of a muzzleloading bullet.

In this patent, the bullet has an outer diameter slightly less than the inner diameter of the firearm barrel, and the gas check has an outer diameter slightly greater than the inner barrel diameter. Kearns provides his gas check member for use with sub-caliber bullets, wherein the diameter of the gas check slightly exceeds that of the bore. The gas check is frictionally attached rearward of the bullet and is constructed of deformable, but durable, plastic.

U.S. Pat. No. 6,481,356 (Gualandi) discloses an enclosed projectile with external ridges on the enclosure for a firearm cartridge. This reference relates to firearm cartridges, and does not relate to muzzleloading firearms. Also, in this reference, the enclosure separates from the side walls of the projectile immediately upon firing, so the enclosure does not interact with the projectile after firing like a sabot does.

U.S. Pat. No. 6,796,068 (Crowson et al.) also discloses a gas check similar to the one disclosed in U.S. Pat. No. 5,458,064, above, with the additional feature of an expanded-shape pin at the back end of the bullet. The pin has a distal end that is larger than its proximal end that is attached to the back of the bullet. An expanded-shape pin installed in a round hole of the gas check provides a gap between the pin and the gas check which allows exploding gases to more easily separate the gas check from the bullet when desired.

U.S. Published Patent Application #2004/0079256 (McMurray et al.) discloses an enclosed projectile with interconnected collapsible fins which create a front compressible section for a projectile from a firearm cartridge. Therefore, this reference does not relate to muzzleloading firearms. Also, in this reference there is no disclosure that the collapsible fins interact with the bore of the firearm after firing, like a gas check does.

Still, there is a need for a gas check for muzzleloading firearms that acts to keep the bullet projectile secured in the barrel, even during the rigors of hunting or other handling prior to shooting the firearm. Also, there is a need for such a gas check that is easy to load, especially after the barrel has been fouled by earlier shooting. There is also a need for a frictionally-attached gas check for use in muzzle-loading firearms that is preferably designed to quickly and reliably detach from the bullet and/or break apart upon firing to minimize interference by the gas check with the bullet after the bullet leaves the bore. Various embodiments of the present invention address selected, or all, of these needs.

SUMMARY OF THE INVENTION

The present invention is a gas check for a muzzle loading projectile, herein called "bullet," the gas check having at least one external ridge and/or at least one internal locking ridge. Also, the present invention may be the combination of the instant gas check, having the external ridge and/or internal locking ridge, and the muzzle loading bullet. The gas check is preferably a soft plastic piece, and has a forward, bullet-interacting part, and a rearward, barrel-interacting part. The bullet-interacting part of the gas check is for connecting the front part of the gas check to the back part of the bullet; preferably, this is accomplished by providing on the bullet a post extending rearwardly to be received in and frictionally engage an aperture/opening on the gas check front side. Preferably, this aperture/opening of the gas check includes, on its axial wall, an internal, radially-inwardly-extending locking ridge for more secure cooperation between the gas check and the post of the bullet. The inwardly-extending ridge may abut and frictionally engage the side surface of the pin of the bullet.

There may be one or several ridges, and, if plural, the ridges may be of the same or different shapes and/or have different spacing between them.

The internal radial ridge(s) assist in securing the gas check to the bullet, especially when the rearwardly-extending post of the bullet has been provided with a cooperating radial indent, cannelure, or retaining ring. The geometry of the internal radial ridge and the cooperating ring may be adjusted relative to each other to more securely interfit and interconnect. Said protruding ridge(s) mating with one or more indents/cannelures/rings, when the gas check of the preferred embodiment is connected to the bullet, serves to prevent the bullet from easily separating from the gas check during the loading and handling steps, and during at least the fractions of a second after firing during which it is desirable to have the bullet and gas check connected to each other. Alternatively, a male ridge may be provided on the bullet post for mating in a female indent/cannelure/ring on the gas check aperture/opening wall surface.

The barrel-interacting part of the gas check is its outer surface that engages the inner surface of the barrel during loading, during any handling, transport or hunting period before firing, and during the period after firing when the projectile (with gas check attached) is accelerating down the barrel before exiting the bore. Preferably, the outer surface of the gas check has a recess and ridge system comprising at least one radial ridge and at least one region that is recesses relative to said ridge. There may be one or several external radial ridges, and the external radial ridges, if plural, may be of the same or different shapes and/or have different spacing between them.

The external radial recess and ridge system of the preferred embodiments assists in convenient loading of the muzzle loading projectile, by minimizing resistance to the gas check being pushed into the barrel. This benefit is achieved by means of the external radial ridge(s) extending beyond the surrounding/adjacent portions of the external surface of the gas check for contacting the bore, with the adjacent portions of the external surface being concave or recessed relative to the ridge(s). This ridge and recess system, therefore, provide (s) less total surface area in contact with the rifle bore at all times, compared to a smooth surface gas check. This way, there is less gas-check-on-bore friction during loading, which is especially attractive when the bore has been fouled by earlier shooting. After loading, the preferred ridges contact the barrel and hold the gas check, with its firmly- and securely-connected bullet, generally centered and stable in the barrel and unlikely to slide out of the barrel. Still, however, the gas check provides enough contact with the inside of the rifle barrel to efficiently capture exploding gases and prevent blow-by upon firing.

Preferably, said capture of gases for preventing said blow-by is accomplished by a cup-shaped gas-capture portion formed at the rear end of the gas check. The gas-capture portion, also called a "skirt," is generally axial, and it is this skirt that also provides the external surface comprising the preferred external recess and ridge system. The interior walls of the skirt tapers to be thinner towards the rear end; this way, the gas check is flexible enough at the rear end to provide, upon firing of the firearm, a good seal in the bore.

The gas check may be made rigid and durable enough at its front end to prevent excessive deformation upon explosion of the powder charge behind the gas check; this way, the front end of the gas check is preferably prevented from collapsing or compressing to a smaller/shorter axial length. Also, due to the rigidity and durability of the front end, and the security of the preferred pin (or "post") and aperture connection system, there is no need in most embodiments for any part of the gas check to extend forward, relative to the plane of the bullet main body rear surface, for additional connection or gas capture or control. Further, while it is preferred that the gas check disengages from the bullet, breaks apart, or otherwise frees the bullet, at about the time or soon after the bullet exits the barrel, said rigidity and durability of the front end of the gas check may be desirable as a means to prevent premature rupture or compression of the gas check during the period of time inside the barrel when the gas check is fulfilling its purpose of capturing gasses and helping to propel the bullet through and out of the barrel.

The gas check may be made with purposely-thin or otherwise weakened portions that allow breakage or shattering of at least a portion of the gas check after the explosion, as stated above, preferably at about the time of, or shortly after, exiting the barrel. The thinness and/or other weakened portions (for providing said breakage or shattering at a desired time or position), are preferably not at the upper shoulders S of the gas check, but are rather in a radial portion of the front wall that abuts against the rear end of the bullet and/or in the skirt in a position wherein the skirt will tend to break only upon exit of the barrel.

DESCRIPTION OF THE PREFERRED EMBODIMENTS

Referring to the Figures, there are depicted several, but not the only, embodiments of the present invention. In this description, "front" means more towards the open end of the firearm barrel, and the front end of the bullet and gas check are toward the open end of the barrel when the bullet and gas check combination is in the breech (or closed end) of the barrel. "Back" means more towards the butt of the firearm, and the back end of the bullet and the gas check are toward the butt of the firearm when the bullet and gas check combination is in the breach.

Figure 1A:
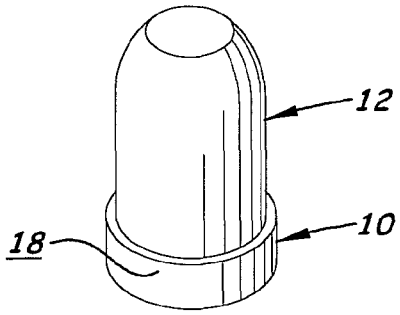
Fig. 1A (PRIOR ART)
FIG. 1A is a side, perspective view of a prior art gas check attached to a bullet.

In FIG. 1A is depicted a side, perspective view of a prior art gas check attached to the back of a muzzleloading bullet. Such prior art gas checks may be of the type described by Kearns in U.S. Pat. No. 5,458,064, for example.

Figure 1B:
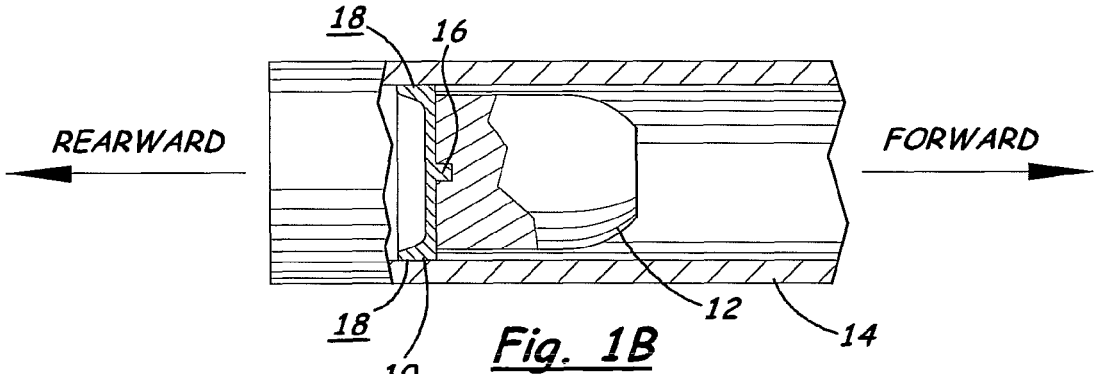
Fig. 1B (PRIOR ART)
FIG. 1B is a schematic, cross-sectional side view of one embodiment of a prior art gas check in a firearm barrel, wherein the gas check is connected to the bullet by means of a forwardly-protruding gas check pin being received in a hole in the bullet.

In FIG. 1B is depicted a cross-sectional side view of the prior art gas check 10 of FIG. 1A affixed to a muzzleloading bullet 12 within firearm barrel 14. Bullet 12 has a central hole/recess into which is frictionally received a pin 16 that extends from the front end of gas check 12. Outer side walls 18 of gas check 10 are uniform and smooth. All or nearly all of the outer side wall 18, all along the axial length of the side wall 18, contacts and interacts with the interior surface of barrel 14.

Figure 1C:
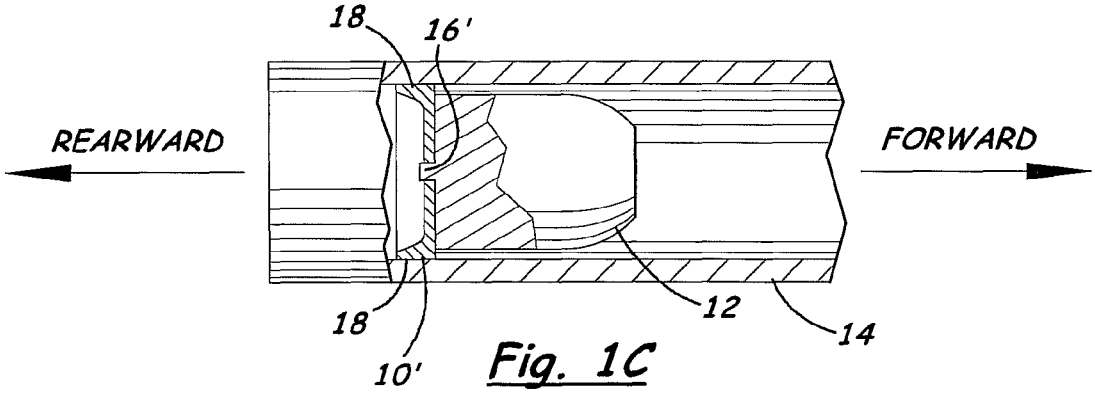
Fig. 1C (PRIOR ART)
FIG. 1C is a schematic, cross-sectional side view of another prior art gas check attached to a bullet, in the barrel of a firearm, wherein the gas check is connected to the bullet by means of a rearwardly-protruding pin on the bullet being received in an aperture in the gas check.
Figure 2:
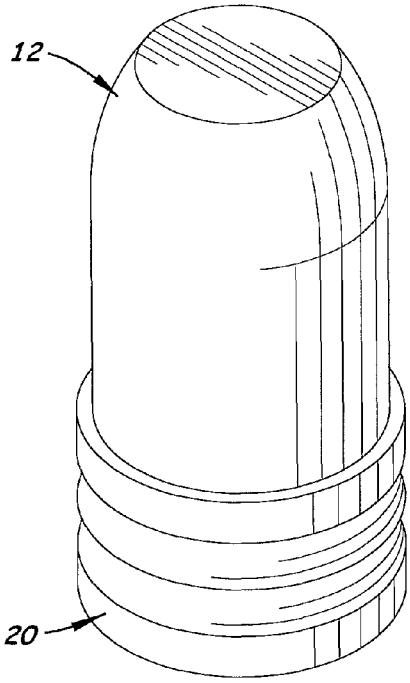
FIG. 2 is a perspective view of one embodiment of the invented gas check connected to one embodiment of a muzzle loading firearm bullet.
Figure 4:
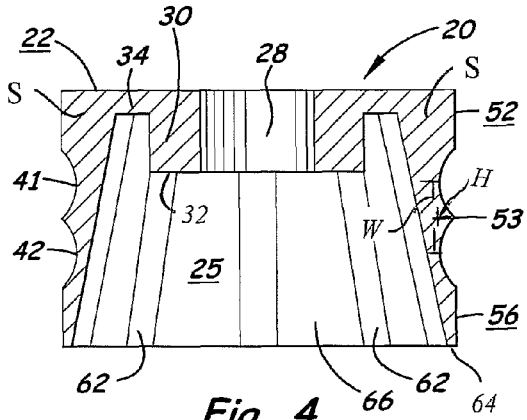
FIG. 4 is a cross-sectional view of the gas check of FIGS. 2 and 3.
Figure 3:
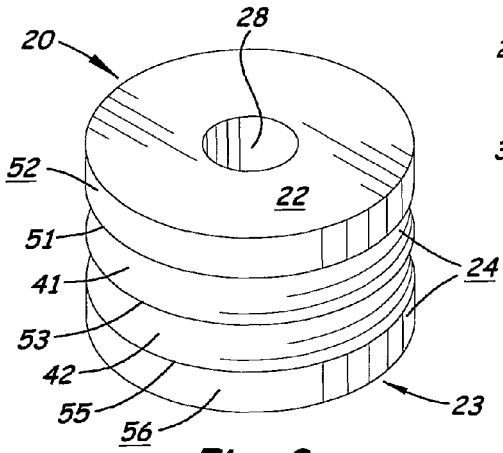
FIG. 3 is a side perspective view of the gas check of FIG. 2.

FIG. 1C illustrates an alternative embodiment of a prior art gas check 10' and bullet 12 combination, the outside of which appears to be the same as the bullet and gas check combination of FIGS. 1A and 1B. The connection between bullet and gas check, however, is different. This gas check 10' has an aperture through its front, radial wall, which frictionally receives a pin 16' extending rearward from the back surface of the bullet. This type of connection is also discussed in Kearns U.S. Pat. No. 5,458,064. Optionally, the pin extending from the back surface of the bullet may be of the shapes described in Crowson, et al. U.S. Pat. No. 6,796,068, for example, wherein the pin 16' may have a distal end that is larger than its proximal end, and/or may also have gaps between the pin 16' and the wall surface of the aperture receiving the pin 16'.

Figure 5:
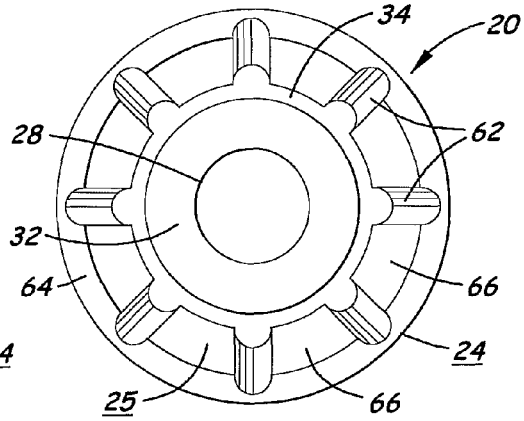
FIG. 5 is a bottom view of the gas check embodiment depicted in FIGS. 2-4.
Figure 6:
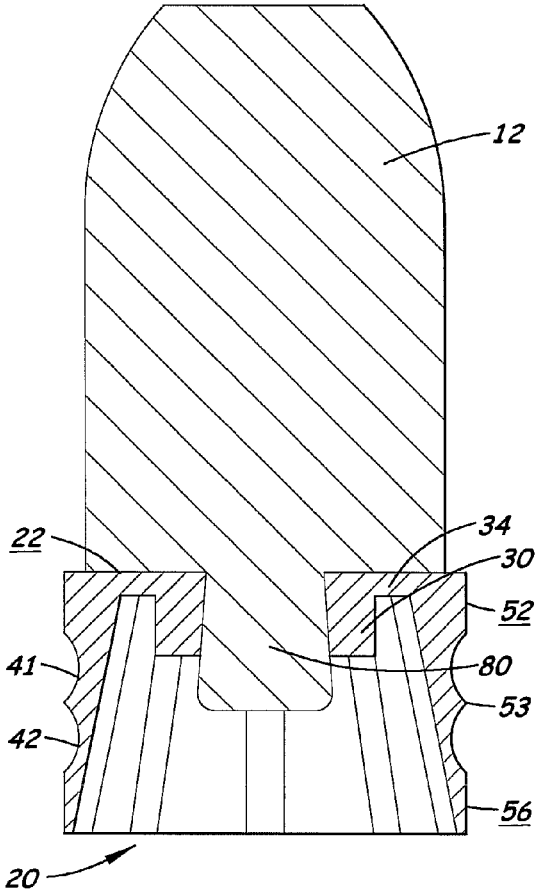
FIG. 6 is a cross-sectional view of the gas check depicted in FIGS. 2-5, affixed to the back of a muzzleloading bullet.

In FIGS. 2-6 are depicted views of one embodiment of the gas check, and said one embodiment of gas check combined with one embodiment of a muzzle loading firearm bullet, according to the instant invention. In FIG. 6 is depicted a schematic, cross-sectional view of the gas check 20 as it is affixed to the back of a muzzle loading bullet 12. The generally central aperture 28 receives a post or pin 80 on the back of the muzzle loading bullet 12, providing preferably a snug fit between the gas check 20 and the bullet 12. While the post 80 is shown as a slightly-expanded-shape post, other pins or posts may be used, for example, ones that are entirely cylindrical. Also, there may or may not be one or more gaps between the post 80 outer surface and the interior side wall surface of the gas check aperture, but significant gaps are not preferred, as a goal of preferred embodiments of this gas check is to create a snug and secure frictional fit of the gas check to the bullet.

Gas check 20 has generally flat front surface 22, and an axial skirt 23 with an external side wall surface 24 and an interior side wall surface 25. Surrounding and defining aperture 28 is an axial ring 30 with a rear surface 32, wherein said axial ring 30 is connected to the skirt 23 by a thin, radial connecting ring 34. This thin, radial connecting ring 34 may be made thin enough to break, after the powder explosion and preferably immediately upon exiting the barrel allowing for freeing the bullet from the gas check so that the bullet proceeds on its flight without interference and without the weight of the gas check.

Side wall surface 24 is an uneven, unsmooth surface, preferably comprising a recess and ridge system. The recess and ridge system may comprise a combination of recessed rings separated or defined at their boundaries by protruding circumferential ridges (or protruding cylindrical surfaces that may still be considered thicker or broader ridges). For example, recessed circumferential rings 41, 42 or other grooves preferably extend circumferentially around the entire side wall surface 24. The material bordering/defining these recessed rings 41, 42 are external circumferential ridges 52, 53, 56 that extend all the way around the gas check and protrude outward radially beyond recessed rings 41, 42 may be called external ridges. The generally cylindrical surface region 52 (which comprises edge 51) above the uppermost recess 41, and the generally cylindrical surface region 56 (which comprises edge 55), may be considered smooth and cylindrical ridges or "blunt" ridges that protrude beyond the adjacent recesses. The ridge 53 that separates the two recessed rings 41, 42 is a thin, relatively sharp ridge, but, alternatively, the ridge 53 separating the two recesses 41, 42 could be broadened so as not to be so sharp.

Some or all of the ridges/edges 52 (with edge 51), 53, and 56 (with edge 55), contact the barrel surface while the bullet and gas check reside in the barrel (during loading, hunting, and until the gas check or fragments of the gas check exit the barrel after filing). This way, the gas check provides enough surface area, spread-out appropriately along the axial length of the gas check, for contact with the barrel, to stabilize and center the gas check in the barrel before and preferably after firing and to perform its gas-check function of catching/sealing explosion gasses from passing by the bullet. However, because a significant amount of the side wall 24 surface area is recessed (41, 42) relative to the protruding ridges/edges 51, 52, 53, 55, 56, the recess/ridge system serves to decrease the total surface area of the gas check in contact with the inner surface of the barrel 14 during the time the bullet and gas check are in the barrel, thus, decreasing the gas-check-on-bore friction especially during loading.

There may be one, two, three, four, or more spaced-apart external ridges included in the exterior side wall 24, including sharp ridges such as ridge 53, and/or broader or flatter ridges 52, 56. Preferably, there are at least two ridges or edges extending around the skirt 23 of the gas check (on the sides of at least one recess) that are spaced apart in the skirt axial direction (that is, higher and lower on the skirt as it is oriented in FIG. 4). A single protruding ridge, with recess on each side, might work in some instances, however, more likely, such a single ridge would make the gas check less stable in the bore and would allow gasses to pass by the gas check, or, if the ridge were broad and the recess small, the surface area would not be reduced sufficiently to make loading easier.

The ridges may be of the same, or different, shape and spaced the same or differently. Typically, external ridge(s) such as the "sharp" one call-out as 53 are between about 0.001" and 0.006" high (H in FIG. 4), and between about 0.001" and 0.006"wide (W in FIG. 4).

The recess and ridge system assists in convenient loading of the muzzleloading projectile 12, while still providing enough contact with the inside of the rifle barrel 14 to hold the bullet in the bore during handling and hunting, and to efficiently capture exploding gases and prevent blow-by. The recess and ridge system provides less total surface area in contact with the rifle bore, compared to a smooth surface gas check. This way, there is less gas-check-on-bore friction during loading, which is especially attractive when the bore has been fouled by earlier shooting.

Skirt 23 forms a relatively thin-walled, rearwardly-opening, generally cylindrical portion of the gas check, which may be described as a cup-shaped gas capture portion, formed at the rear end of the bullet-check combination, for gas capture upon explosion of the powder charge behind the gas check 20. In FIG. 5 is depicted a bottom view of the embodiment of the preferred gas check, showing another view of the generally central aperture 28, and the interior wall surface 25 of the skirt 23. The external walls of the gas capture portion are generally axial, with the interior walls 25 of the gas capture portion also generally axial but tapered so that the skirt is thinner towards the rear end. This way, the gas check skirt 23 is flexible enough at its rear end to flex, stretch, or otherwise slightly expand to provide a good seal in the bore. The gas check front end, however, is rigid and durable enough to prevent significant deformation, compression, or shrinkage, of the gas check especially in the axial direction while it travels through the bore.

FIG. 5A schematically depicts the muzzle loading bullet 12 connected with the gas check 20 by way of insertion of the bullet post 80 through the generally central aperture 28. Preferably, the post 80 has a small diameter relative to the diameter of the main body of the bullet, and it may be said that the preferred gas check does not cover any of the main body of the bullet except for extending along the rear surface of the main body and surrounding the post that protrudes from the main body. Thus, the gas check connects to a relatively small protruding portion (post 80) of the bullet rather than to the main body itself. For example, it is preferred that said post have a diameter equal to or less than about ⅓ of the diameter of the main body of the bullet, and that the gas check preferably does not extend along any axial surface of the main body of the bullet.

Figure 7A:
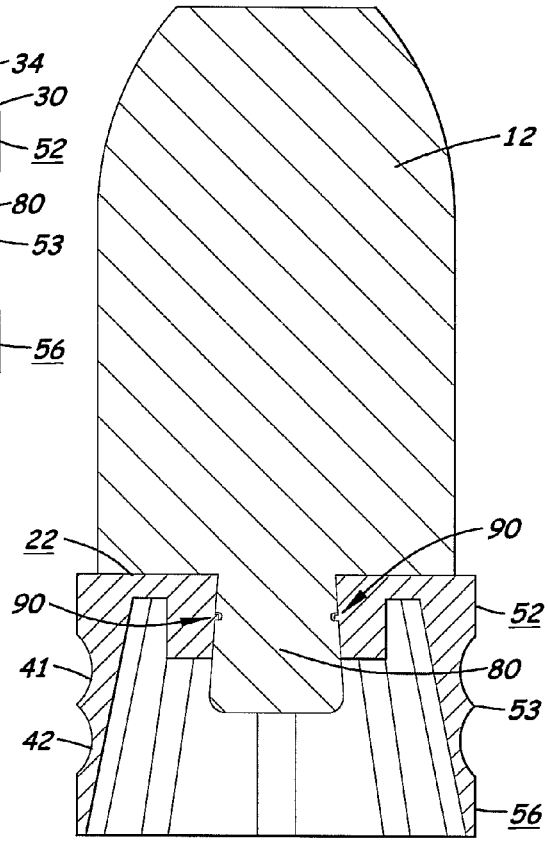
FIGS. 7A, B, C, and D is a series of cross-sectional side views depicting different interfits between various embodiments of an internal ridge of the gas check and various embodiments of a retaining ring on the post of the bullet, according to several embodiments of the invention.
Figure 7B:
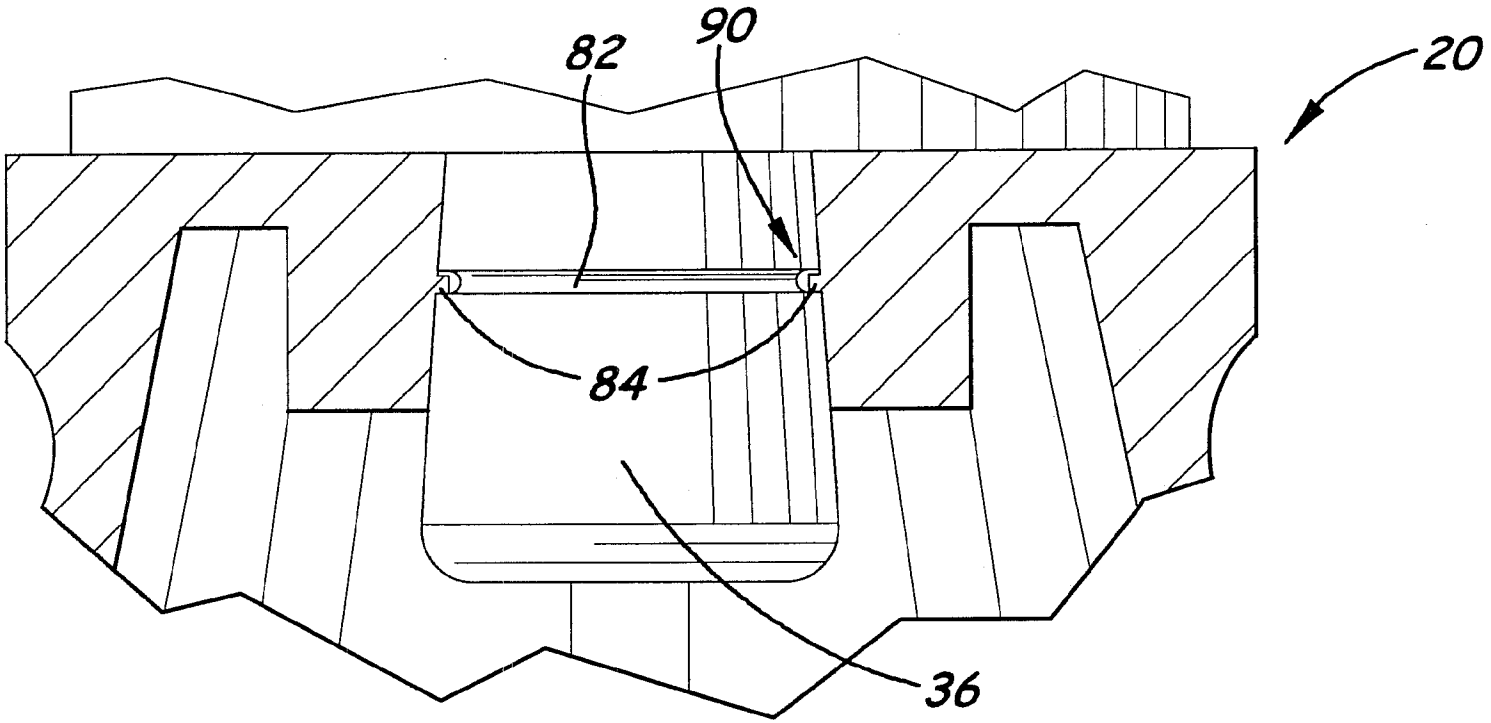
Figure 7C:
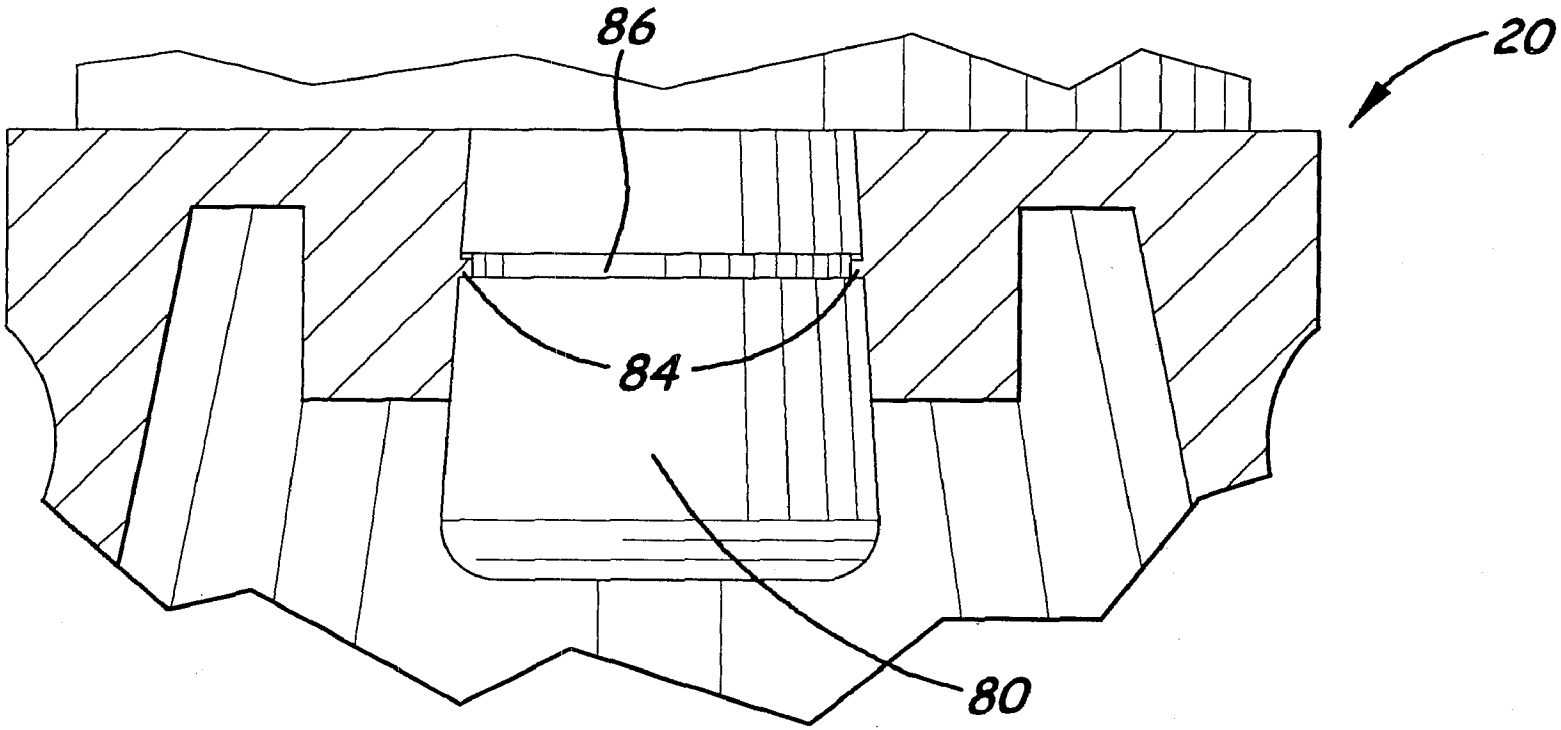
Figure 7D:
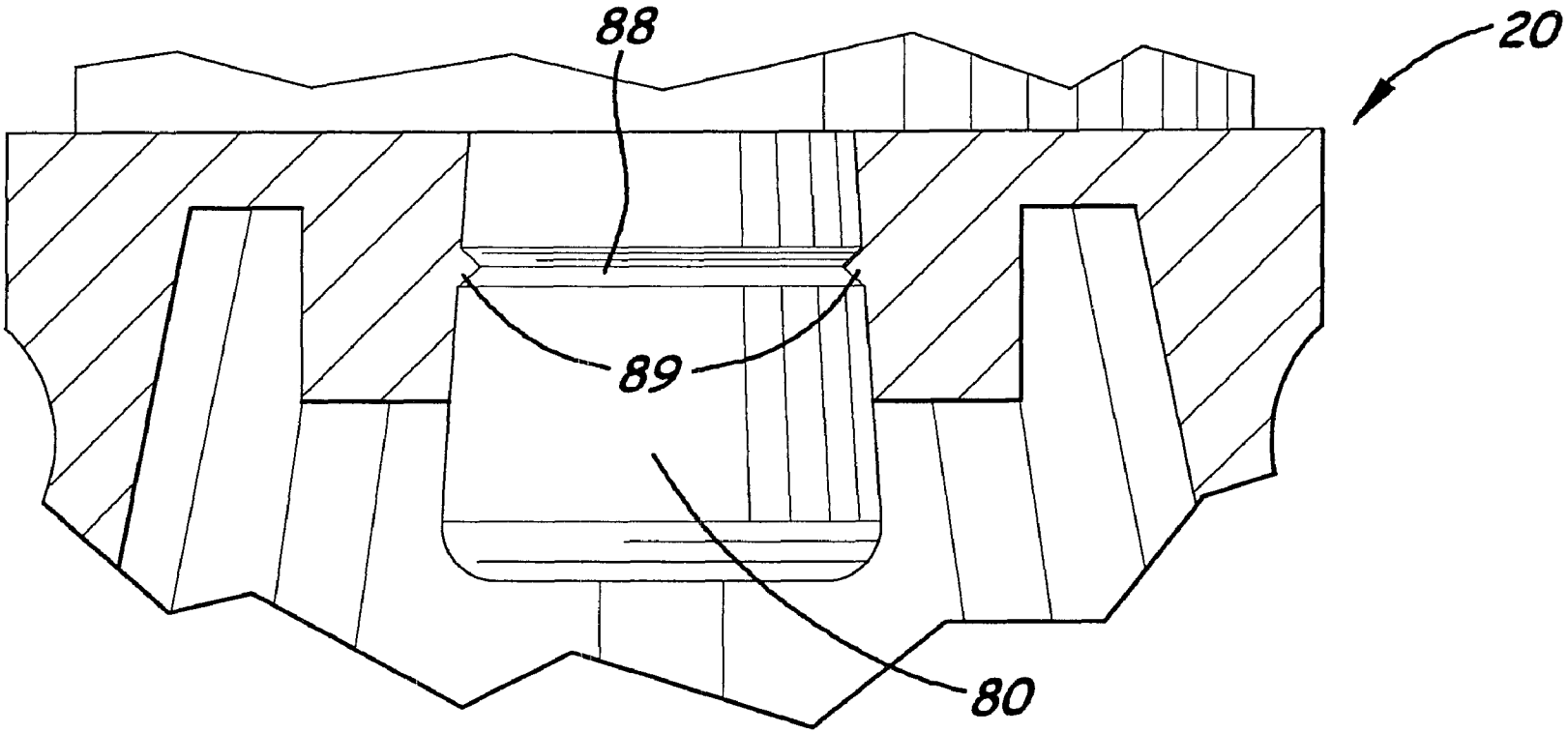

As may be seen in FIG. 7A and enlarged FIGS. 7B-D, an internal locking system 90 preferably resides on the inside surface of aperture 28 and preferably also the outside surface of post 80. Locking ridge 84 protrudes inward toward the axis of the gas check from the peripheral wall of aperture 28. This locking ridge 84 assists in securing the gas check 20 to the bullet 12, by frictional gripping or engaging of the back post 80 of the bullet 12. Preferably, back post 80 of the bullet 12 has been provided with a cooperating radial indent, cannelure, or retaining ring 82. This way, the gas check 20 is more firmly secured to the bullet 12, and vice-versa, so there is little chance that the gas check and bullet will disconnect during loading or during carrying and handling prior to firing. Consequently, when the projectile with the gas check 20 of the present invention is seated in the bore of the barrel, in front of the powder charge, the bullet 12 will not easily separate from the gas check 20, and will not easily fall out of the barrel 14. Preferably the internal ridges are between about 0.001" and 0.006" high, and between about 0.001" and 0.006" wide.

FIGS. 7A and 7B illustrate a version of the internal locking system 90 that includes a generally rectangular locking ridge 84 received in a curved, concave ring 82; thus, said ridge 84 and ring 82 do not exactly match in shape, but the ridge 84 is caught in ring 82 well enough to improve the security of the gas check-to-bullet connection. FIG. 7C illustrates an alternative version of an internal locking ridge system, wherein a rectangular ridge 84 is captured in a rectangular ring 86. FIG. 7D illustrates another alternative internal locking ridge system, wherein a wedge-shaped ridge 89 closely matches and mates with a wedge-shaped ring 88. Many other styles, sizes, and numbers of ridges/rings may be used. For example, a slightly deeper groove at the rearward portion of the ring may cooperate with a slightly longer extending portion of the internal radial ridge of the gas check at that same location; such a close and accurate mating may more firmly secured to the bullet, and vice-versa.

Figure 8:
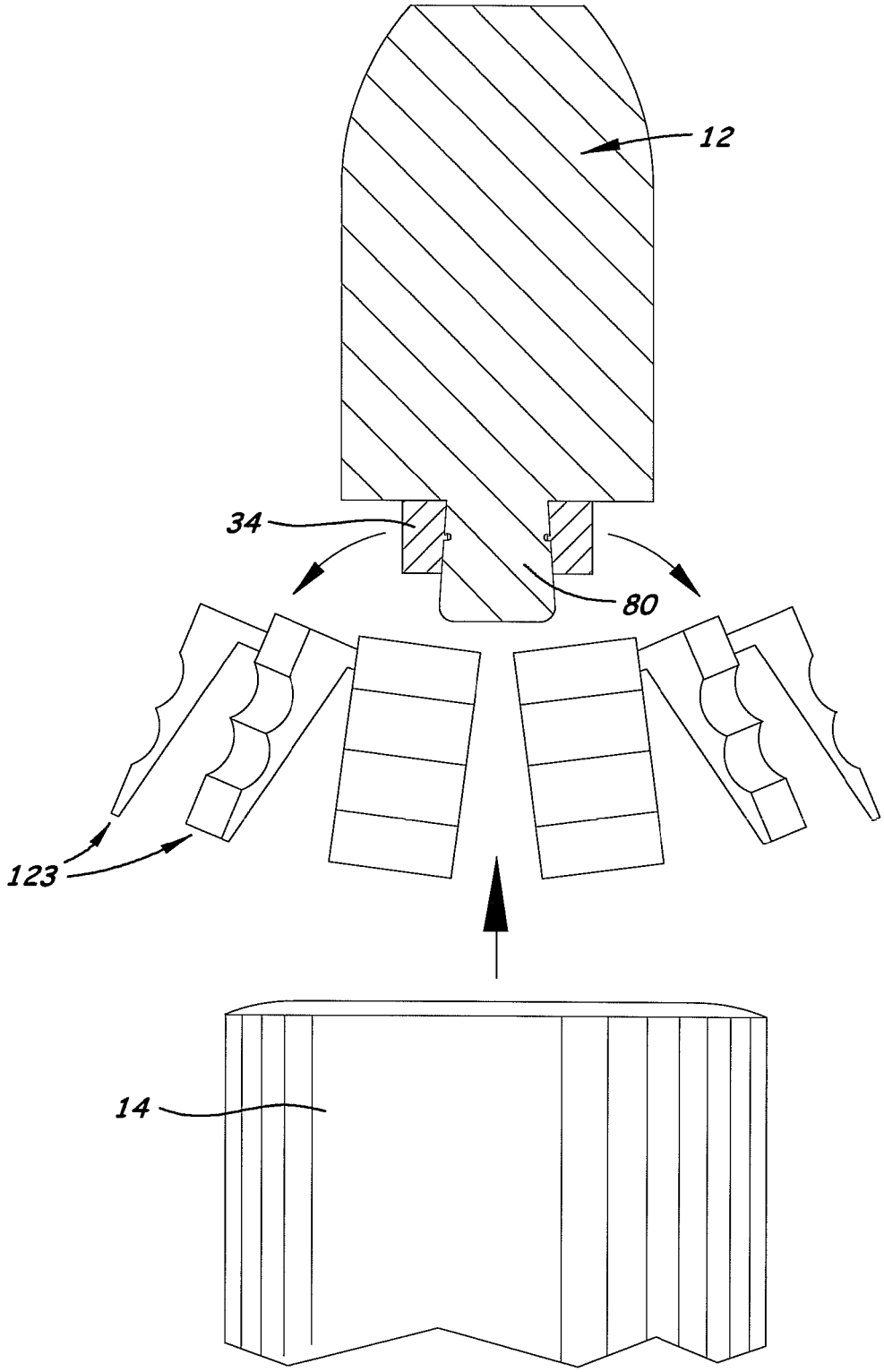
FIG. 8 is a schematic illustration of one possible fragmentation of one embodiment of the invented gas check upon leaving a firearm barrel.

The preferred embodiments are made so that upon exiting the barrel, the gas check will disengage, detach, or break off of the bullet, or otherwise free the bullet. Rather than the entire gas check "popping" off of the bullet, for example, by means of aperture 28 disconnecting from the post 80, the preferred mechanism of detachment involves the fracture of the gas check member at one or more locations, under the force of the gases rushing towards the uncapped distal end of the barrel or under the force of said gases and the sudden freeing of the gas-check-and-bullet combination from the barrel. For example, the fracture may occur at its forward end, along a connective band or "annular disk" between the engaging member and the outer skirt (for example, ring 34, discussed below), and/or at one or more locations on the outer skirt (for example, grooves 62, discussed below). The gas check is preferably engineered to rupture along both said annular disk and a plurality of thin, scored, or otherwise weakened axial lines on the outer skirt, such as grooves 62. Upon exiting the barrel, the skirt of the gas check separates from the bullet, and/or breaks into multiple pieces 123, allowing the bullet to continue, unimpeded, toward the target. See the schematic illustration in FIG. 8 of possible gas check fracture upon leaving the muzzle loading firearm barrel.

Therefore, while the interior wall surface 25 of the skirt 23 may be of various shapes, the preferred is a cylindrical wall with axial grooves running from at or near the rearmost end 64 of the skirt 23 to the ring 34. There may be various numbers, sizes, and shapes of said axial grooves, but it is preferred that there be 6-9 of said grooves spaced evenly around the circumference of the skirt 23 for symmetry of the skirt. These grooves 62 may serve to make the skirt 23 more flexible and expandable for its purpose of sealing against the bore wall of the barrel to capture the gases from the powder explosion. These grooves may serve, in addition or instead, as weakened regions of the skirt for allowing the skirt to break apart at a desired time during the travel of the bullet and gas check, as discussed above. Preferably, immediately upon exit from the barrel, the skirt 23 will break off of the axial ring 30 and/or will break apart at grooves 62, so that there is little or none of the gas check left on the bullet as it travels beyond the barrel. Note that, preferably, the interior surface 25 of the skirt comprises no circumferential grooves or recesses, as this might weaken the skirt in a direction that might allow axial compression (such as "accordion" collapsing of the skirt) or other deformation other than the preferred slight radial expansion or flexing. Note that, preferably, there are no axial grooves or other breaks or indents in the external ridges (52/51, 53, 56/55), as these ridges should be circumferentially continuous for sealing with the bore all the way around the gas check.

Other connection means may be used to connect the gas check to the bullet. For example, the gas check may comprise a skirt extension that extends forward from the shoulder S of the preferred gas check and along the bullet. This is not preferred, however, and tends not to be necessary, as the preferred light-weight gas check (simply connecting at the pin and aperture connection and having a recess and ridge system) is effective in bullet retention in the bore and gas capturing.

Other embodiments of the invention may also be made and used after one of skill in the art reads this disclosure and views the drawings. Although this invention has been described above with reference to particular means, materials and embodiments, it is to be understood that the invention is not limited to these disclosed particulars, but extends instead to all equivalents within the scope of the following claims.

We claim:

1. A gas check and muzzle loading bullet combination, wherein:

the bullet has a side surface and a rear end surface from which a bullet post extends rearwardly;

the gas check has an external side wall, and a front surface with an aperture for receiving the bullet post, wherein said aperture is defined by an internal side wall;

wherein the external side wall is an outer wall of a rearwardly-extending skirt of the gas check, and the skirt has an inner axial surface comprising axial grooves;

wherein the external side wall of the gas check has at least one ridge and at least one adjacent recess, wherein the at least one ridge is adapted to contact a bore of a muzzle loading firearm and the at least one recess is adapted to not contact said bore; and wherein no part of the gas check extends along said bullet side surface.

2. A combination as in claim 1, wherein said inner axial surface comprises no circumferential grooves.

3. A combination as in claim 1, wherein said internal side wall comprises a ridge engaging a recessed circumferential ring extending around said bullet post.

4. A combination as in claim 1, wherein said at least one recess comprises two recesses with two ridges adjacent, and one ridge between, said two recesses.

5. A combination as in claim 1, wherein said gas check is connected to the bullet only by connection of said post to said internal side wall of the aperture.

6. A gas check for connection to a muzzle loading bullet, the gas check comprising:

a radial front wall having an aperture defined by an internal side wall;

a skirt extending axially from said radial front wall and having an external axial wall and an interior axial wall, wherein the interior axial wall surrounds and defines a cup-shaped space for capturing gasses from a muzzle loading firearm powder explosion;

wherein the external axial wall comprises a plurality of circumferential recesses and at least one ridge between said recesses; and wherein said interior axial wall comprises axial grooves adapted to weaken the skirt.

7. A gas check as in claim 6, wherein said interior axial wall comprises 6-9 of said grooves.

8. A gas check as in claim 6, wherein said internal side wall defining the aperture comprises a protruding ridge that is adapted to grip a portion of a bullet for connecting the gas check to the bullet.

9. A gas check as in claim 6, wherein said radial front wall comprises an annular disk between said skirt and the aperture that is adapted to break upon the gas check exiting a barrel of the muzzle loading firearm.

10. A gas check and bullet combination for a muzzle loading firearm having a barrel with a bore surface, the gas check comprising:

a radial front wall having an aperture defined by an internal side wall;

a skirt extending axially from said radial front wall and having an external axial wall and an interior axial wall, wherein the interior axial wall surrounds and defines a cup-shaped space for capturing gasses from a muzzle loading firearm powder explosion;

wherein the external axial wall comprises a plurality of circumferential recesses and at least one ridge between said recesses; and wherein said interior axial wall comprises axial grooves adapted to weaken the skirt; and wherein said circumferential recesses are adapted to not contact said bore surface, and said at least one ridge is adapted to contact said bore surface, so that total surface that contacts the bore surface is limited for easier loading of the gas check and bullet combination into the barrel and so that said at least one ridge seals against the bore surface for capturing explosion gasses.

11. A combination as in claim 10, wherein said gas check is connected to said bullet by means of a post extending rearwardly from a rear surface of the bullet is frictionally received in said aperture.

12. A combination as in claim 11, wherein said an internal side wall comprises at least one protruding locking ridge, and said post comprising a cooperating indent, so that said locking ridge latches into said cooperating indent.

13. A combination as in claim 11, wherein said skirt interior axial wall comprises axially-extending grooves that extend into the skirt.

14. A combination as in claim 13, wherein said skirt is adapted to break apart at said grooves upon said gas check exiting said firearm bore.

15. A combination as in claim 11, wherein the radial front wall comprises a thin annular portion adapted to break upon said gas check exiting said firearm bore.

16. A combination as in claim 11, wherein said post is larger at a distal end than at a proximal end nearer the bullet rear surface.

17. A combination as in claim 11, wherein said rear surface is a rear surface of a main body of the bullet, and wherein said post has a diameter less than or equal to ⅓ of the diameter of the main body of the bullet.

* * * * *